US005791520A

United States Patent [19]

Tichenor

[11] Patent Number: 5,791,520

[45] Date of Patent: Aug. 11, 1998

[54] UTILITY-POWER OPERATED AEROSOL SPRAY CAN

[76] Inventor: Clyde L. Tichenor, 905 N. Oak St., Fillmore, Calif. 93015

[21] Appl. No.: 767,593

[22] Filed: Dec. 14, 1996

[51] Int. Cl.[6] ..... B65B 5/00

[52] U.S. Cl. ..... 222/82; 222/504

[58] Field of Search ..... 222/82, 333, 402.11, 222/402.13, 402.15, 504

[56] References Cited

U.S. PATENT DOCUMENTS

| | | | |
|---|---|---|---|
| 3,187,949 | 6/1965 | Mangel | 222/82 X |
| 3,189,014 | 6/1965 | Kus | 222/504 X |
| 3,661,133 | 5/1972 | Rasch | 222/504 X |
| 3,666,144 | 5/1972 | Winder | 222/504 X |
| 3,848,775 | 11/1974 | Possell | 222/504 X |
| 3,974,941 | 8/1976 | Mettler | 222/504 X |
| 4,088,247 | 5/1978 | Hickman | 222/504 X |
| 4,512,587 | 4/1985 | Burke et al. | 222/504 X |
| 5,318,208 | 6/1994 | Van Der Wal | 222/403.13 |
| 5,385,271 | 1/1995 | Bierend et al. | 222/504 X |
| 5,427,277 | 6/1995 | Bierend et al. | 222/402.11 X |

*Primary Examiner*—Kevin P. Shaver
*Attorney, Agent, or Firm*—Albert O. Cota

[57] ABSTRACT

An aerosol spray can (12) that can only be operated when connected to a utility a-c power source. Thus, the use of the spray can (12) to spray graffiti is prevented or at least minimized. The aerosol spray can (12) is modified by attaching to its upper surface (14) a can top seal (20) that includes an upper threaded section (22), a puncturable seal (30) and a lower siphon tube sleeve (32) to which is attached a conventional siphon tube (34). The can (12) functions in combination with a solenoid valve assembly (40) that is located within a vitreous housing (42) that includes a threaded lower end (68). When the valve assembly (40) is threaded into the cap top seal (20), the seal (30) is punctured allowing paint to flow upward into the valve assembly (40). The solenoid valve assembly (40) remains closed until it is opened by an energized separable or permanently attached magnetic coil (120) which is located around the valve assembly (40). The coil (120) is energized only when the utility a-c power source is applied to the coil (120) through an a-c line plug (132).

11 Claims, 4 Drawing Sheets

UTILITY-POWER OPERATED AEROSOL SPRAY CAN

TECHNICAL FIELD

The invention pertains to the general field of anti-graffiti aerosol spray cans that prevent the use of theses cans in remote field situations and more particularly to an aerosol spray can that can only be operated when connected to an a-c utility power source.

BACKGROUND ART

Graffiti can consist of any unauthorized name, word or symbol, or any combination thereof, that is disposed upon public or private property. A majority of graffiti can be attributed to gangs or individuals known as "taggers". The motives behind graffiti can vary, from the mundane—pragmatic vandalism, to the criminally significant—establishing gang "turfs" or neighborhood possession boundaries. Today, there is hardly a blank wall in most inner cities that does not display some for of graffiti.

To curtail the application of graffiti, several plans, devices and activities have been implemented. The transit authorities of some cities have taken cars out of service for cleaning as soon as they are marred by graffiti. One real life test presented a bus in perfect condition to a group of taggers who were secretly under observation. They completely covered the bus inside and out with graffiti in about 5 minutes. In addition to the cost involved in trying to eradicate graffiti, there is also the monetary loss resulting from decreased property values and the intangible psychological effects of living in a city resembles a war zone.

It should further be noted that it takes more paint to cover graffiti than to create it. Currently, laws are in effect that restrict the sale of conventional spray paint cans to persons 18 years old and older and in certain localities. There are other laws that designed to limit aerosol spray paint can sales to cans that are not portable, such as depicted in this invention.

A search of the prior art did not disclose any patents that read directly on the claims of the instant invention, however the following U.S. patents are considered related:

| U.S. Pat. No. | INVENTOR | ISSUED |
|---|---|---|
| 5,294,022 | Earle | March 1994 |
| 4,483,466 | Gutierrez | November 1984 |
| 3,666,144 | Winder | May 1972 |

DISCLOSURE OF THE INVENTION

Previous patents submitted by the applicants of the instant application have incorporated graffiti control valves within the aerosol spray can itself. This invention presents a simpler can modification which allows tamper control of the can, thus preventing use for graffiti. The valve, which is comprised of a solenoid valve assembly, is incorporated within a vitreous valve housing that is threaded onto the can top by either a right or left hand thread. Threading the external valve housing onto the can top punctures a seal, allowing paint to access the valve assembly through a screw-in spray head.

Since the solenoid valve assembly cannot be removed without exposing an open top on the spray can, and the valve assembly requires electro-magnetic activation, the can is therefore tamper-proof and graffiti resistant. By using a housing made of a vitreous material to contain the armature assembly of the solenoid valve, the housing cannot be punctured, drilled or cut without shattering and destroying the housing. Additionally, on a pressurized spray can, this action would cause the paint to be uncontrollably released in all directions.

When the can is empty, the valve housing may be removed and cleaned for use on a different color paint or mounted onto the top of a new can of paint having the same color. Since the valve housing assemblies are inexpensive several housings may be retained by a typical user.

The utility a-c power operated valve assembly and its associated sealed aerosol spray can are designed in combination, to dispense a fluid only if a separable magnetic coil, also referred to as an activator, is attached around the valve assembly at the can's top. The activator is connected by means of a power cord, to a utility a-c power receptacle. Therefore, "taggers" are prevented from using the inventive spray cans in areas not having access to a utility a-c power source. The activator is energized by electronic power input circuit which is operable only when connected to an a-c power source. The circuit will not operate in the presence of a square wave (inverter) type, a d-c voltage and high or low uncontrolled frequencies different from 60 Hz as found in small portable sine wave generators.

While there is value in a separable solenoid coil, there can also be valves in a non-separable coil and valve assembly as also described herein.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
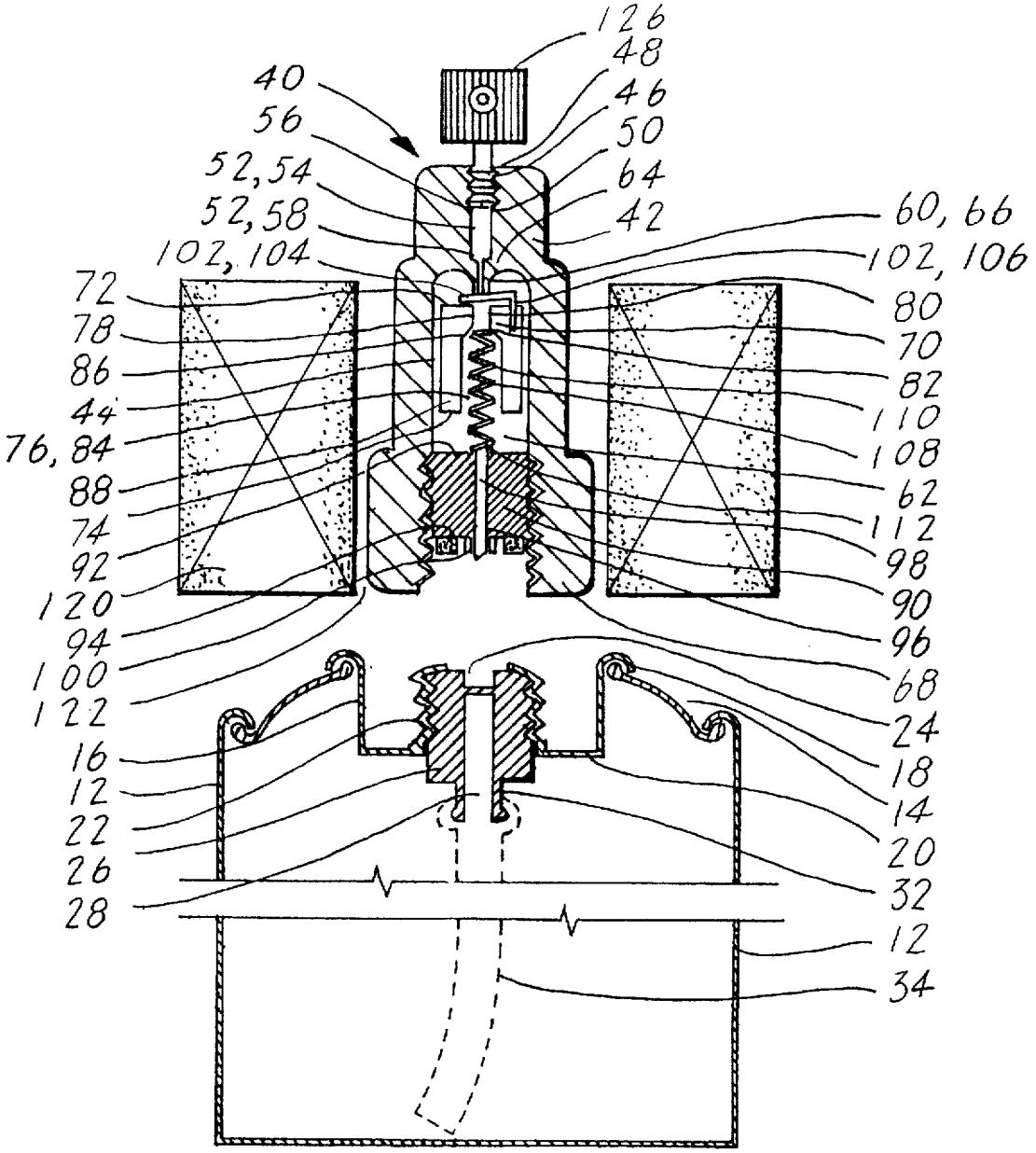
FIG. 1 is a partial sectional view of a separable solenoid valve assembly that is threaded into a modified aerosol spray can.

The best mode for carrying out the utility-power operated aerosol spray can 10 is presented in terms of a preferred embodiment that is disclosed in two designs. In the first design, a separable magnetic coil 120 or activator 120 is placed over a valve assembly 40, while in the second design the activator 120 is permanently attached to the valve assembly 40.

The first design, as shown in FIGS. 1–4 and 6, is comprised of the following major elements: an aerosol spray can 12, a can top seal 20, a threaded seal and siphon tube support 26, a siphon tube 34, a valve assembly 40 having a vitreous housing 42, a slidable steel armature 70, a threaded bottom seal plug 90, a compliant valve leaf 102, a return spring 108, a magnetic coil 120 and a screw-in spray head 126.

The aerosol spray can 12, as shown in the lower half of FIG. 1, includes an upper surface 14 having an opening 16 into which is inserted and attached, by an attachment means 18, a can top seal 20. The seal 20 includes an upward protruding, integral threaded section 22 having an upper central opening 24. Inserted into the threaded section 22 is a threaded seal and siphon tube support 26. The support has a central opening 28 having near its upper end a puncturable seal 30. Extending from its lower end is a siphon tube sleeve 32 into which is captively inserted the upper end of a siphon tube 34.

The valve assembly 40, as also shown in FIG. 1, consists of a housing 42 that is constructed of a vitreous material such as ceramic or glass. The housing 42 has a composite central opening 44 that houses the following elements:

a) an upper threaded section 46 having an upper end 48 and a lower end 50, b) an upper housing bore 52 having an upper section 54 with an upper end 56 that interfaces with the lower end 50 of the upper threaded section 46. The bore 52 also has an integral lower section 58 having a lower end 60 and a diameter that is less than the diameter of the upper section 54.

c) a central housing cavity 62 having an upper end 64 configured in a downward extending conic section that terminates with a bore 66 and a threaded lower end 68. The conic section bore 66 interfaces with the lower end 60 of the lower section 58 of the upper housing bore 52.

d) a slidable steel armature 70 having an upper surface 72, a lower surface 74 and an armature bore 76. The armature bore 76 includes an upper section 78 with an upper end 80 and a lower end 82, and an integral lower section 84 having an upper end 86 and a lower end 88. The lower section also has a diameter that is larger than the diameter of the upper section, as shown in FIG. 1.

e) a threaded bottom seal plug 90 having an upper surface 92, a lower surface 94 and a central bore therethrough 96. The plug 90 also includes an upper spring retaining sleeve 98 and a lower seal piercing sleeve 100. The plug 90 is dimensioned to be threaded into the threaded lower end 68 of the central housing cavity 62.

f) a compliant valve leaf 102 that is preferably made of neoprene or the like. The leaf includes a horizontal section 104 and an integral vertical section 106. One end of the vertical section 106 as shown in FIG. 1, is attached to one side of the upper surface 72 of the slidable steel armature 70. The horizontal section 104 is movably located between the conic section bore 66 and the upper surface 72 of the slidable steel armature 70.

g) a return spring 108 having an upper end 110 that rests against the upper end 86 of the lower section 84 of the armature bore 76. The spring's lower end. 112 extends outward from the lower end 88 of the lower section 84 of the armature bore 76 and is inserted into the spring retaining sleeve 98 on the bottom seal plug 90 as also shown in FIG. 1 . The spring 108 normally biases the slidable steel armature 70 in an upward direction, compressing the compliant valve leaf 102 against the conic section bore 66.

The magnetic coil 120, which is also best shown in FIG. 1, includes a central opening 122 that is dimensioned to be removably located over the vitreous housing 42. When a source of utility power is applied to the coil 120 by an application means, a magnetic field is produced which forces the slidable armature 70 downward. This action then causes the compliant valve leaf 102, to be pulled away from the conic section bore 66. This second action allows the paint to flow upwards, sequentially, from the siphon tube 34, through the central opening 28 in the siphon tube support 26, the punctured seal 30, the central bore 96 on the bottom seal plug 90, located the armature bore 76, the upper housing bore 52, and into and out the screw-in spray head.

The preferred embodiment is also manufactured with a resilient washer 128 which is preferably made of rubber. The washer, as shown in FIG. 1, presses against the lower surface of the bottom seal plug 90 when the vitreous housing 42 is screwed firmly into the can top seal 20.

The utility-power operated aerosol spray can 10 operates with a means for applying a source of utility a-c power. This means is preferably comprised of an electronic power-input circuit 130, which controls and allows power to be applied to the magnetic coil 120 only when the power is derived from a utility a-c power receptacle.

Figure 2:
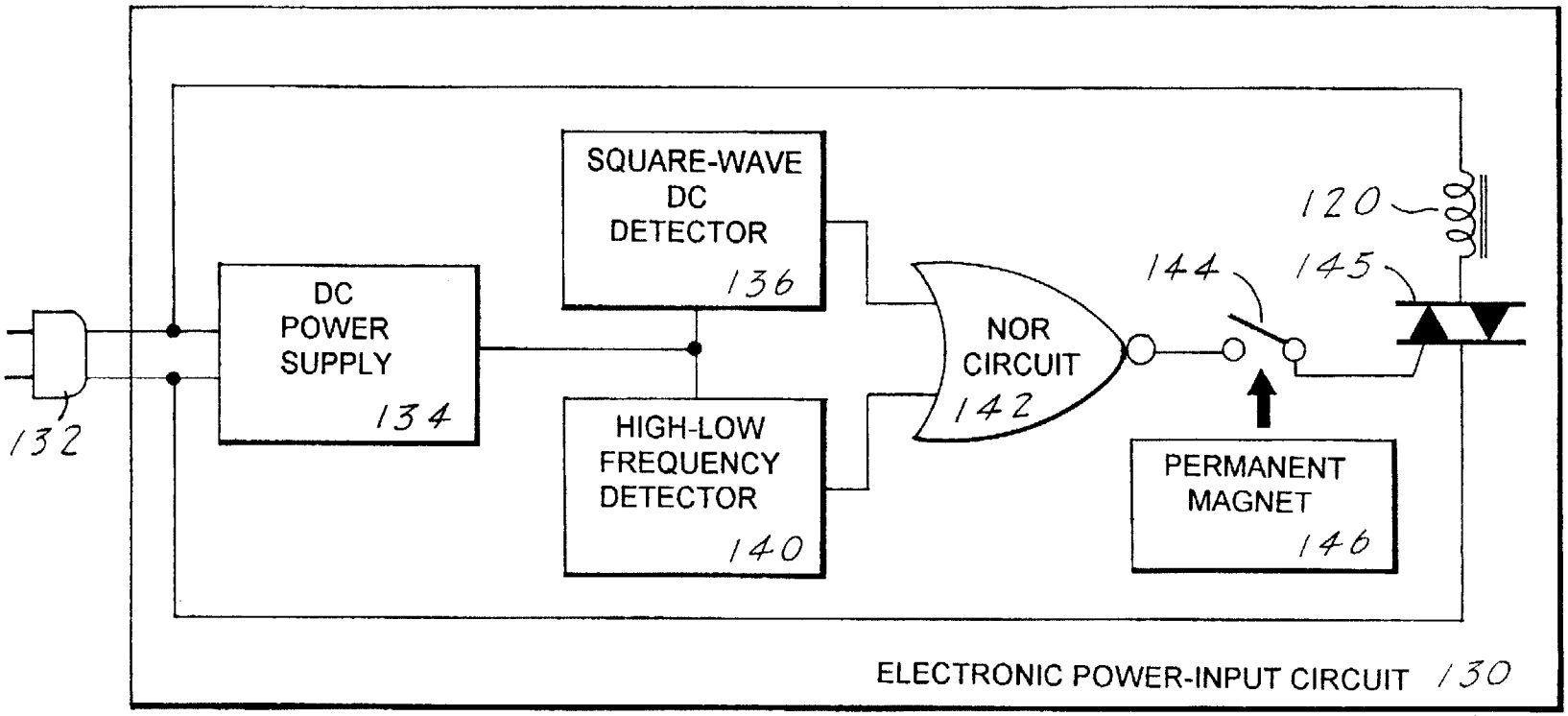
FIG. 2 illustrates a typical block/schematic diagram for an electronic power input circuit.

A typical electronic power-input circuit 120, as shown in FIG. 2, is comprised of an a-c line plug 132 which supplies the utility 120 volt a-c power to a d-c power supply 134. The power supply 134 applies power to activate a square wave/d-c detector 136 and a high-low frequency detector 140. The output of the detector 136, 140 are applied to a NOR circuit 142. The Nor circuit can be enabled by either the square wave/d-c detector 136 or the high-low frequency detector 140.

The output of the NOR gate 142 is applied to one side of an explosion proof reed switch 144, the other side of the switch is connected to a triac 145. The reed switch is activated by a permanent magnet 146 controlled by a mechanical trigger 150. When the reed switch is activated, the output of the NOR gate is applied to the triac 145 which, in turn, controls the application of the utility a-c power to the magnetic coil 120.

Figure 3:
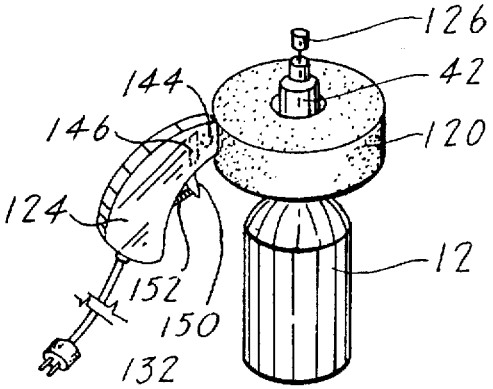
FIG. 3 is a perspective view of the electronically activated magnetic coil attached to an aerosol spray can and the activator attached to a pistol-grip handle which includes a trigger switch that, when pressed, applies power to the activator.

In FIG. 3, the aerosol spray can 12 is shown beneath the magnetic coil 120 which, in turn, has attached to its housing a pistol-grip 124 which contains the permanent magnet 146 and the mechanical trigger 150. When the trigger 150 is squeezed, the reed switch 148 closes which then energizes. The coil 120 is positioned around the separable valve assembly 40 located within the vitreous housing 42. A suitable locking means retains the aerosol spray can 12 and the vitreous housing 42 within the magnetic coil 120.

Figure 4:
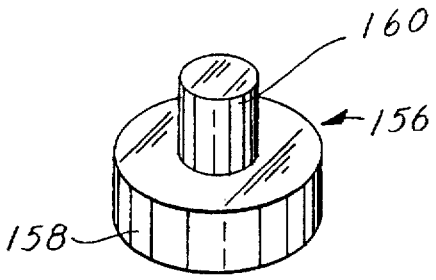
FIG. 4 is a perspective view of a protective can cap.

In FIG. 4 is shown a perspective view of a protective cap 156. The cap is comprised of a snap-on base cylinder 158 dimensioned to be snapped into the inner perimeter of the aerosol spray can 12 and a centered integral valve shield 160 that is dimensioned to fit over and protect the vitreous housing 42.

Figure 5:
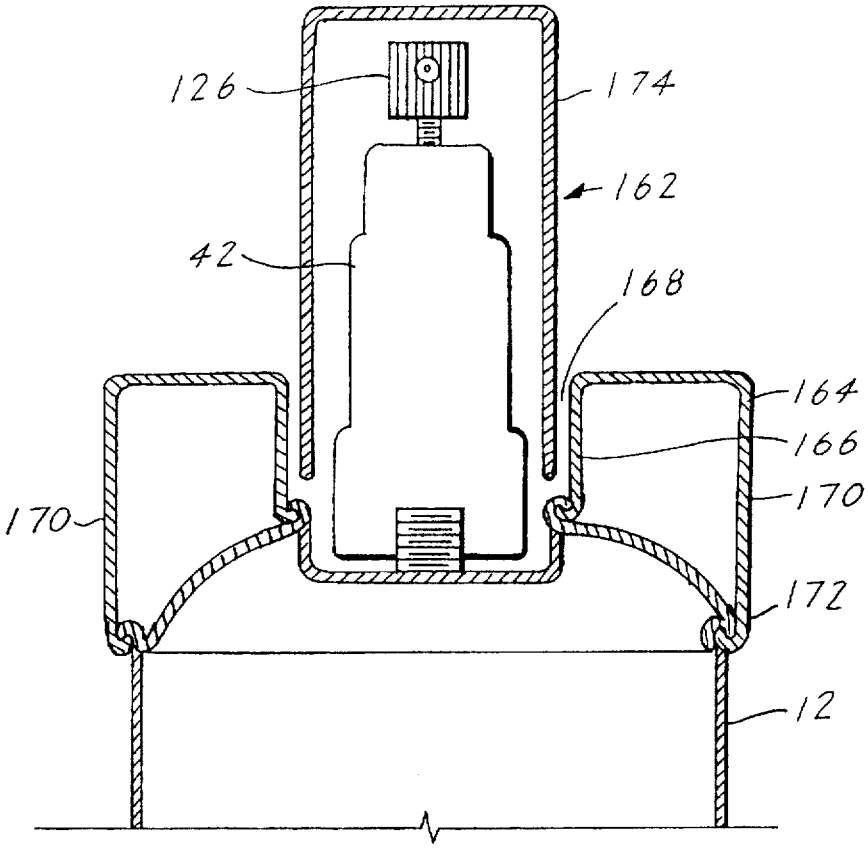
FIG. 5 is a partial sectional view of a protective cap with a removable cover to allow spraying.

In FIG. 5 is shown another design for a protective cap 162. This design includes two parts: an outer section 164 and a separate valve shield 174. The outer section 164 has an inner wall 166 that forms a cavity 168 and an outer wall 170. The outer wall includes a lower end 172 that snaps into the inner perimeter of the aerosol spray can 12. The valve shield 174 is dimensioned to fit over and protect the vitreous housing 42 when the valve shield 174 is inserted into the cavity 168 on the outer section 164.

Figure 6:
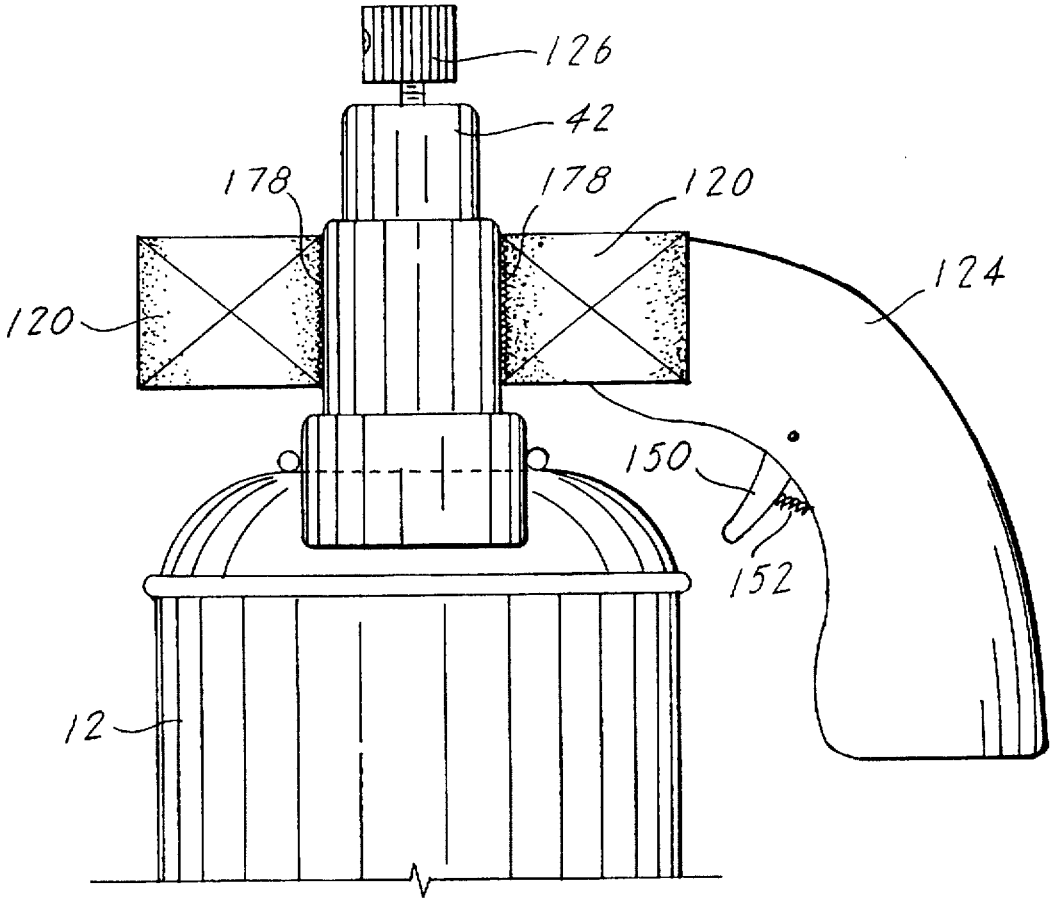
FIG. 6 is a partial sectional view of a magnetic coil permanently attached to the valve assembly.

The second design of the invention is shown in FIG. 6. In this second design, the magnetic coil 120 is attached permanently to the vitreous housing 42 by a bonding means 178. Also shown in FIG. 6 are the screw-in spray head 126, the pistol-grip 124 with its trigger 150 and the trigger spring 152. The remainder of the elements are identical to those of the first design.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A utility-power operated aerosol spray can comprising:

A. an aerosol spray can having:

(a) an upper surface having an opening into which is inserted and attached, by an attachment means, a can top seal that includes an upward protruding, integral threaded section having an upper central opening, (b) a threaded seal and siphon tube support that is threaded into the threaded section on said can top seal, said support having a central opening that has near its upper end a puncturable seal and extending from its lower end a siphon tube sleeve into which is captively inserted an upper end of a siphon tube, B. a valve assembly consisting of a vitreous housing having a composite central opening comprising:

(a) an upper threaded section having an upper end and a lower end, (b) an upper housing bore having an upper section with an upper end that interfaces with the lower end of the upper threaded section and an integral lower section having a lower end and a diameter that is less than the diameter of the upper section, (c) a central housing cavity having an upper end configured in a downward extending conic section that terminates with a bore and a threaded lower end, wherein the conic section bore interfaces with the lower end of the lower section of said upper housing bore, (d) a slidable steel armature having an upper surface, a lower surface and an armature bore having an upper section with an upper end and a lower end and an integral lower section having an upper end, a lower end, and a diameter that is larger than the diameter of the upper section, (e) a threaded bottom seal plug having an upper surface, a lower surface and a central bore therethrough, an upper spring retaining sleeve and a lower seal piercing sleeve, wherein said plug is threaded into the threaded lower end of said central housing cavity, (f) a compliant valve leaf having a horizontal section and an integral vertical section, where in the vertical section is attached to one side of the upper surface of said slidable steel armature and the horizontal section is movably located between the conic section bore and the upper surface of said slidable steel armature, (g) a return spring having an upper end that rests against the upper end of the lower section of the armature bore and a lower end that extends outward from the lower end of the lower section of the armature bore and is inserted into the spring retaining sleeve on said bottom seal, wherein said spring normally biases said slidable steel armature in an upward direction compressing said compliant valve leaf against the conic section bore, and C. a magnetic coil having a central opening that is dimensioned to be removably located over said vitreous housing, wherein when a source of utility power is applied to said coil by an application means a magnetic field is produced which forces said armature downward which then causes said compliant valve leaf to be pulled away from the conic section bore to allow paint to flow upwards sequentially from said siphon tube, through the central opening in said siphon tube support, said punctured seal, the central bore located on said bottom seal plug, the armature bore, the upper housing bore, and into and out the screw-in spray head.

2. The assembly as specified in claim 1 wherein said vitreous housing is constructed of a ceramic material.

3. The assembly as specified in claim 1 wherein said vitreous housing is constructed of a glass compound.

4. The assembly as specified in claim 1 wherein said compliant valve leaf is constructed of neoprene.

5. The assembly as specified in claim 1 further comprising a resilient washer which is pressed against the lower surface of said bottom seal plug when said vitreous housing is screwed firmly into said can top seal.

6. The assembly as specified in claim 1 wherein said means for applying a source of utility power comprises an electronic power-input circuit which controls and allows power to be applied to said magnetic coil only when power is applied from a utility a-c power receptacle.

7. The assembly as specified in claim 6 wherein said electronic power-input circuit comprises:

a) an a-c line plug which supplies the utility 120 volt a-c power to a d-c power supply, b) a square wave/d-c detector and a high-low frequency detector which are activated by said d-c power supply, c) a nor circuit which is enabled by either said square wave/d-c detector or said high-low frequency detector, and d) a reed switch that is activated by a permanent magnet controlled by a mechanical trigger, wherein when said reed switch is activated, the output of said nor gate is applied to a triac which controls the application of the a-c power to said magnetic coil.

8. The assembly as specified in claim 7 wherein said magnetic coil has an outer housing that is attached to a pistol grip which contains said permanent magnet and said mechanical trigger.

9. The assembly as specified in claim 1 further comprising a protective cap comprising a snap-on base cylinder dimensioned to be snapped into the inner perimeter of said spray can and a centered integral valve shield that is dimensioned to fit over and protect said vitreous housing.

10. The assembly as specified in claim 1 further comprising a protective cap comprising:

a) an outer section having an inner wall that forms a cavity and an outer wall having a lower end that snaps into the inner perimeter of said aerosol spray can, and b) a separate valve shield dimensioned to fit over and protect said vitreous housing when said valve shield is inserted into the cavity on said outer section.

11. A utility-power operated aerosol spray can comprising:

A. an aerosol spray can having:

(a) an upper surface having an opening into which is inserted and attached, by an attachment means a can top seal that includes an upward protruding, integral threaded section having an upper central opening, (b) a threaded seal and siphon tube support that is threaded into the threaded section on said can top seal, said support having a central opening that has near its upper end a puncturable seal and extending from its lower end a siphon tube sleeve into which is captively inserted an upper end of a siphon tube, B. a valve assembly consisting of a vitreous housing having a composite central opening comprising:

(a) an upper threaded section having an upper end and a lower end, (b) an upper housing bore having an upper section with an upper end that interfaces with the lower end of the upper threaded section and an integral lower section having a lower end and a diameter that is less than the diameter of the upper section, (c) a central housing cavity having an upper end configured in a downward extending conic section that terminates with a bore and a threaded lower end, wherein the conic section bore interfaces with the lower end of the lower section of said upper housing bore, (d) a slidable steel armature having an upper surface, a lower surface and an armature bore having an upper section with an upper end and a lower end and an integral lower section having an upper end, a lower end, and a diameter that is larger than the diameter of the upper section, (e) a threaded bottom seal plug having an upper surface, a lower surface and a central bore therethrough, an upper spring retaining sleeve and a lower seal piercing sleeve, wherein said plug is threaded into the threaded lower end of said central housing cavity, (f) a compliant valve leaf having a horizontal section and an integral vertical section, wherein the vertical section is attached to one side of the upper surface of said slidable steel armature and the horizontal section is movably located between the conic section bore and the upper surface of said slidable steel armature, (g) a return spring having an upper end that rests against the upper end of the lower section of the armature bore and a lower end that extends outward from the lower end of the lower section of the armature bore and is inserted into the spring retaining sleeve on said bottom seal, wherein said spring normally biases said slidable steel armature in an upward direction compressing said compliant valve leaf against the conic section bore, and C. a magnetic coil having a central opening that is dimensioned to be permanently attached over said vitreous housing by a bonding means, wherein when a source of utility power is applied to said coil by an application means a magnetic field is produced which forces said armature downward which then causes said compliant valve leaf to be pulled away from the conic section bore to allow paint to flow upwards sequentially from said siphon tube, through the central bore on said bottom seal plug, the armature bore, the housing upper bore, and into and out the screw-in spray head.

* * * * *